United States Patent [19]

Wright

[11] Patent Number: 4,998,900

[45] Date of Patent: Mar. 12, 1991

[54] SELF-RIGHTING INFLATABLE LIFE RAFT

[76] Inventor: Derek Wright, 962 Plymouth Pl., North Vancouver, B. C., Canada, V7H 2J2

[21] Appl. No.: 540,183

[22] Filed: Jun. 19, 1990

Related U.S. Application Data

[63] Continuation-in-part of Ser. No. 386,446, Jul. 28, 1989, abandoned.

[51] Int. Cl.[5] ..... B63B 35/58

[52] U.S. Cl. ..... 441/38; 114/349

[58] Field of Search ..... 441/38, 40, 35; 114/348, 349, 345, 360

[56] References Cited

U.S. PATENT DOCUMENTS

| | | | |
|---|---|---|---|
| 3,054,124 | 9/1962 | Silverstone | 441/38 |
| 3,268,925 | 8/1966 | Serra | 9/11 |
| 4,001,905 | 1/1977 | Givens | 9/11 |

FOREIGN PATENT DOCUMENTS

| | | | |
|---|---|---|---|
| 527063 | 7/1956 | Canada . | |
| 864382 | 4/1961 | United Kingdom | 441/38 |

*Primary Examiner*—Ed Swinehart

*Attorney, Agent, or Firm*—Glenn D. Bellamy

[57] ABSTRACT

A self-righting inflatable life raft including a raft body having inflatable sidewalls and an inflatable member extending from the raft body having a buoyant portion sufficient to provide lifting force to move the raft's center of gravity beyond its point of rotation on the surface of water such that the raft will topple by gravity to an upright position. The inflatable member may include a plurality of inflatable tube portions which extend from an upper edge of the raft sidewalls to a first predetermined position upwardly and outboard from the upper edge and which then extend inboard to centrally converge with one another at a second predetermined position above the raft body.

3 Claims, 5 Drawing Sheets

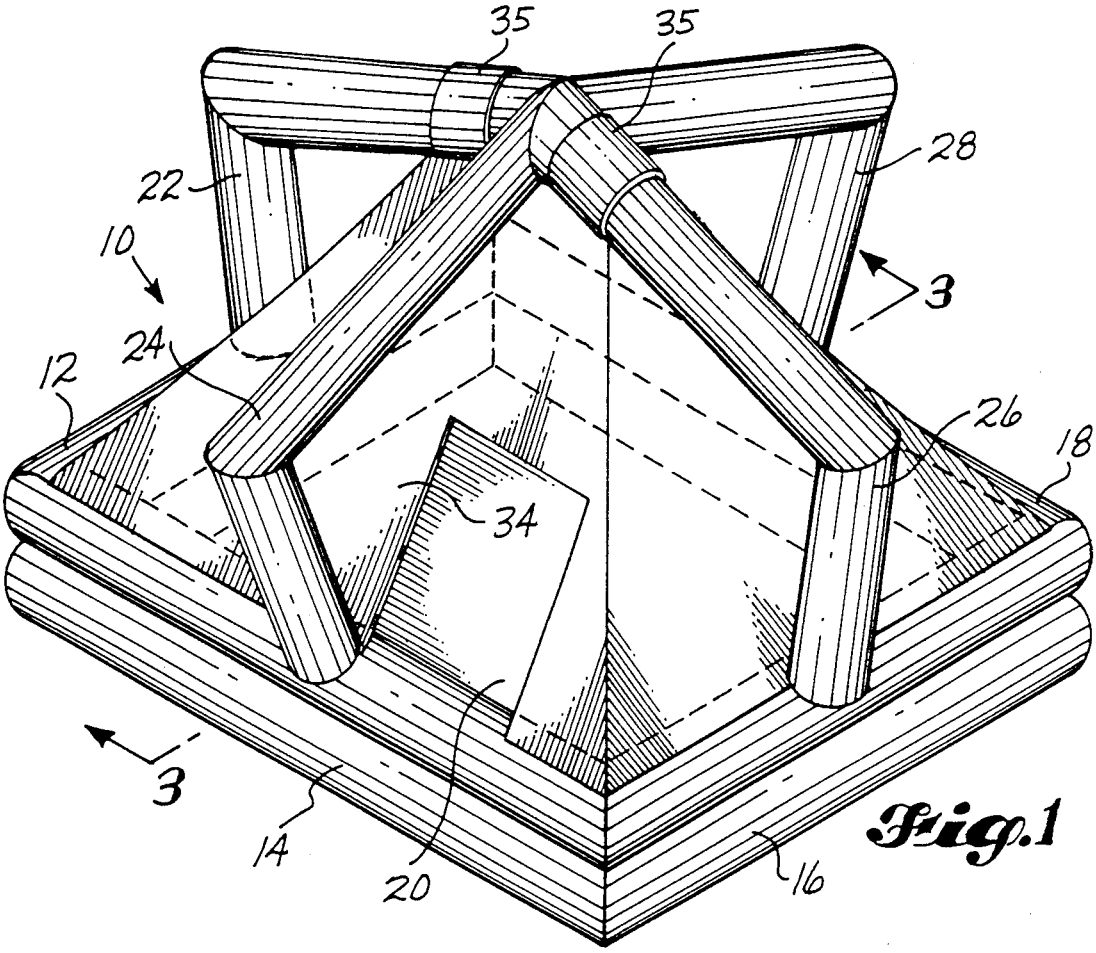
Fig. 1
Fig. 2
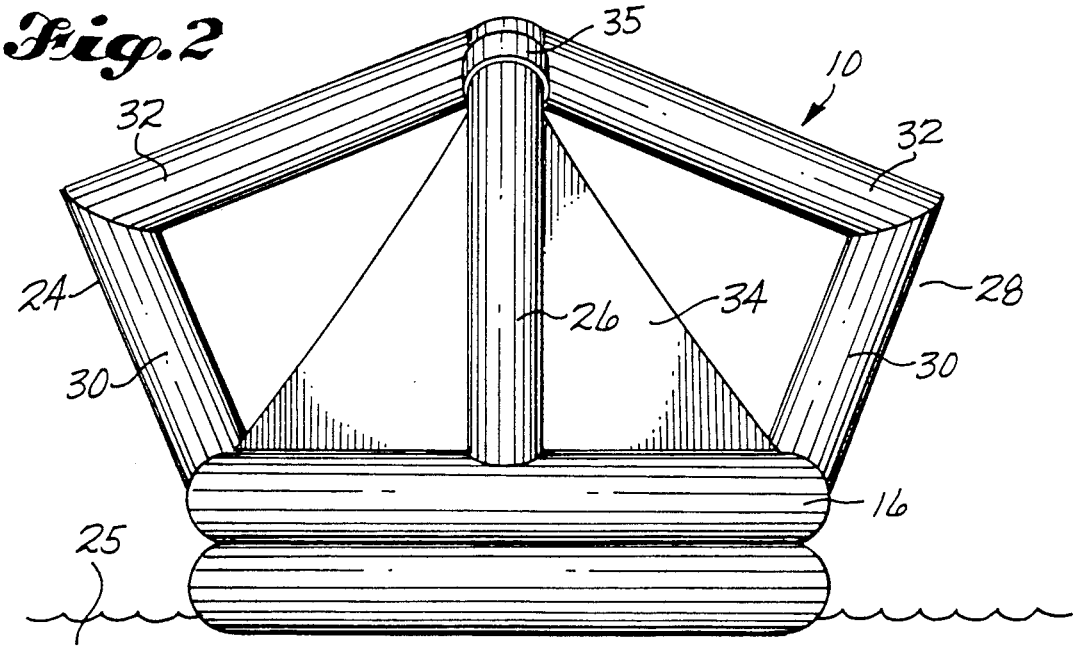

Fig. 3
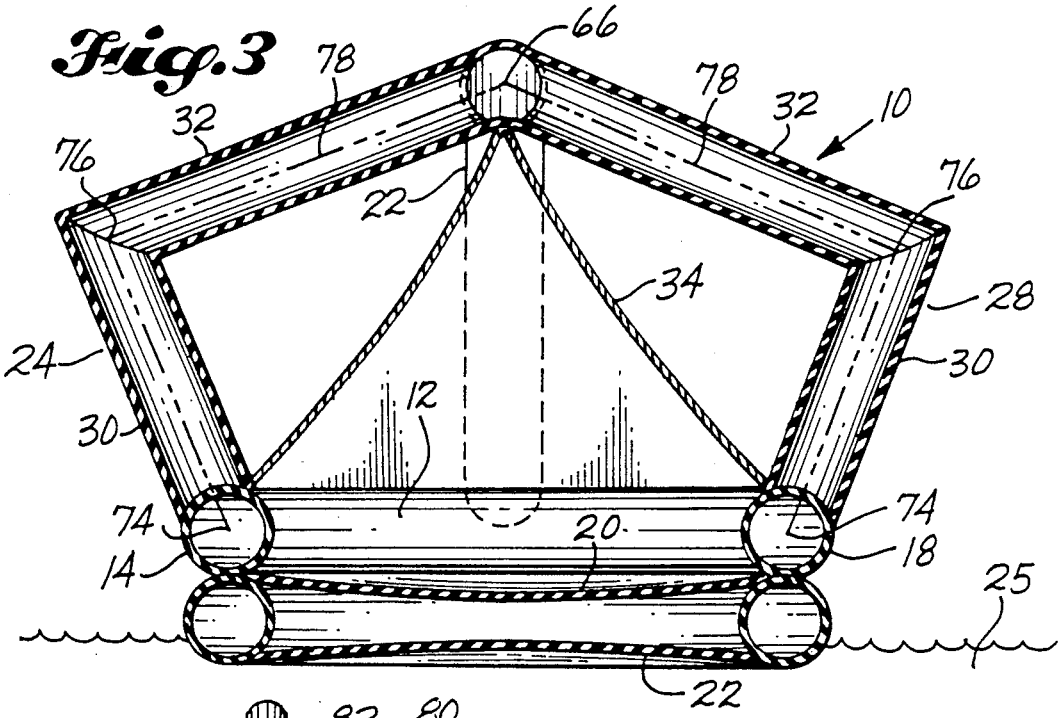
Fig. 4
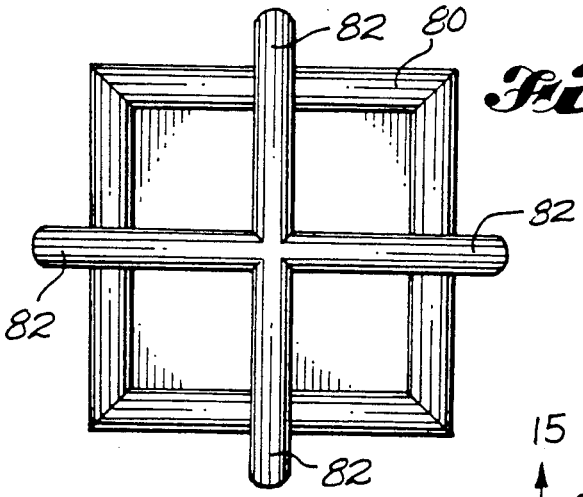
Fig. 5
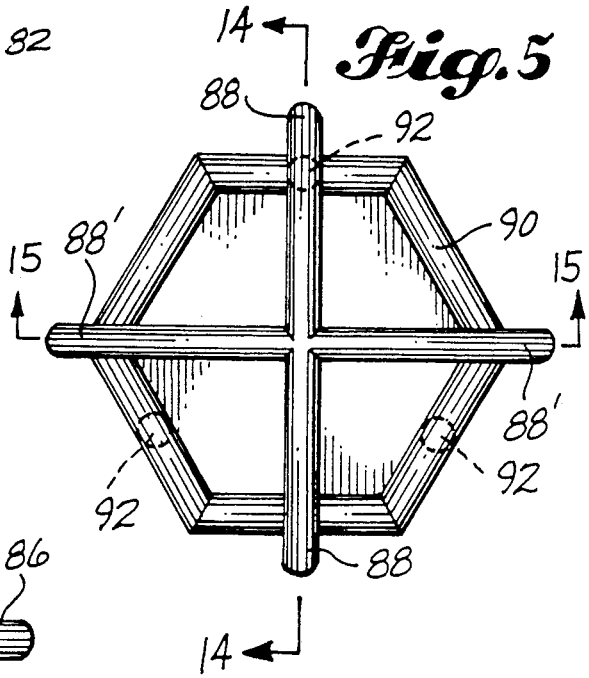
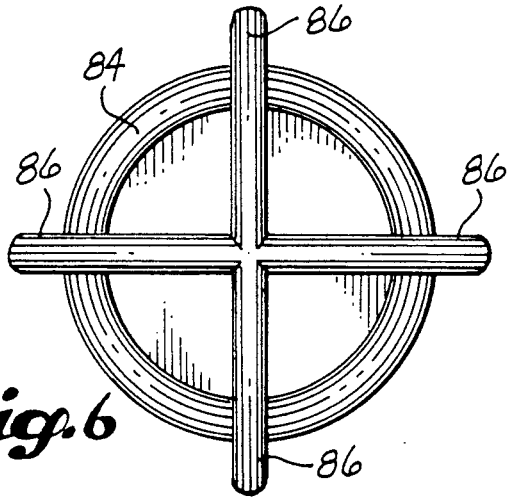
Fig. 6

SELF-RIGHTING INFLATABLE LIFE RAFT

RELATED APPLICATIONS

This application is a continuation-in-part of my copending U.S. patent application Ser. No. 07/386,446, filed July 28, 1989.

TECHNICAL FIELD

This invention relates to an inflatable life raft having canopy support tubes dimensioned and positioned to cause a life raft to turn upright in the water without assistance if the raft inflates in an inverted position or to return an inflated raft to an upright position if it is subsequently overturned.

BACKGROUND ART

Coast Guard regulations in the United States and most foreign countries require vessels over a certain size or carrying a certain number of passengers to have life boats or life rafts on board in case of emergency. The presently more-popular alternative is to carry inflatable life rafts because of the relatively small amount of storage space required when the rafts are in a deflated condition. The presently-used life rafts come in a variety of sizes and shapes, including oblong, square, circular, or substantially circular multi-sided, depending upon the number of occupants they are designed to carry. These rafts are typically made of a rubber or rubberized flexible material and include air chambers which, when fully inflated, provide relatively rigid sidewalls. For protection against severe weather, most of these life rafts include a canopy cover which is supported by inflatable tubes which also become relatively rigid when fully inflated.

Typically, the inflatable life rafts include a compressed gas canister which may be manually or automatically activated to inflate the air chambers of the raft. Unfortunately, the rafts will not necessarily inflate in an upright position and, if overturned upon inflation, must be righted before they can be occupied.

Present Coast Guard requirements specify that approved life rafts must be capable of being uprighted by a single person in the water. While this can usually be accomplished by a healthy individual in calm water, this cannot necessarily be accomplished in rough or extremely cold water or by a person who is injured or fatigued. Such adverse conditions are not entirely unlikely to occur when a vessel is sinking on navigable waters.

The presently commonly-used type of inflatable life raft has not significantly changed in general design since about 1948. British Patent Specification No. 864,382, published Apr. 6, 1961, suggest making an inflatable canopy shaped substantially in the form of a sphere and to arrange the center of gravity to be below the geometric center so that the raft will be self-righting. Due to the large amount of material required to construct such a canopy, the cost of such a structure is considerable. Also, in order to cause the canopy to have buoyancy sufficient to overcome the mass of the raft, a canopy or canopy support of this shape is relatively massive itself. Furthermore, when subjected to rough seas and high winds, the significant surface area of such a structure can make it vulnerable to being tossed and rolled upon the water.

SUMMARY OF THE INVENTION

The present invention provides a reliable means for self-righting an inflatable life raft without intervention on the part of survivors. Provided is a raft body having inflatable sidewalls and a line of rotation defined at the outer perimeter of the raft body upon which it rotates or rolls on the surface of the water when moved from an inverted position to an upright position. The raft body has a center of gravity which is spaced a first predetermined distance from this line of rotation. An inflatable member extends from the raft body and has a buoyant portion spaced a second predetermined distance from the line of rotation. This portion has buoyancy sufficient to provide force at the second predetermined distance to move the center of gravity sufficiently beyond the line of rotation such that the raft body will topple by gravity to an upright position.

A preferred form of the invention includes a plurality of inflatable tube portions, each having a central longitudinal axis which extends from the upper edge of a sidewall to a first predetermined position upwardly and outboard from the upper edge and which then extends inboard to centrally converge with another of the inflatable tube portions at a second predetermined position above the raft body. The positions to which these tubes extend may be determined by a particular formula based on calculatable and experimentally ascertainable specifications of any size or shaped raft.

Other features and advantages of the present invention will become apparent from a reading of the following best mode of carrying out the invention and inspection of the accompanying drawings and claims, all of which are incorporated into this disclosure by specific reference.

BRIEF DESCRIPTION OF THE DRAWINGS

Like reference numerals are used to indicate like parts throughout the various figures of the drawing, and wherein:

FIG. 1 is a pictorial view of an oblong self-righting life raft according to a preferred embodiment of the present invention;

FIG. 2 is an end view of the self-righting life raft shown in FIG. 1;

FIG. 3 is a cross-sectional view taken substantially along line 3—3 of FIG. 1;

FIG. 4 is a top plan view of a square life raft according to the present invention;

FIG. 5 is a top plan view of a hexagonal life raft according to the present invention;

FIG. 6 is a top plan view of a round life raft according to the present invention;

BEST MODE FOR CARRYING OUT THE INVENTION

Figure 7:
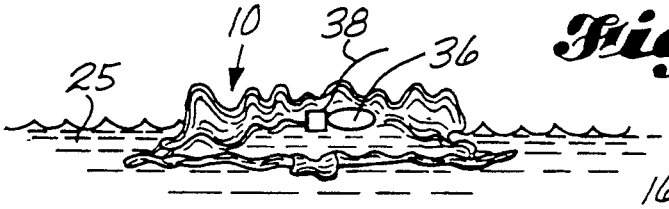
FIGS. 7–12 are sequential views showing inflation of the life raft body and canopy support tubes in which the raft inflates in an overturned position and self-rights to an upright position.

Referring now to the several figures of the drawing, and first to FIG. 1, therein is shown an oblong or rectangular life raft 10 according to a preferred embodiment of the invention. The present invention is suitable for use with life rafts of all shapes, including oblong, square, circular, or substantially circular multi-sided shapes such as hexagonal or octagonal. For the purposes of describing the construction and design of the present invention, an oblong raft is illustrated and will be described in detail. It should be understood, however, that the invention applies equally to all shapes and that the present specification will allow a person of ordinary skill in the art to construct a life raft according to the present invention of any general shape.

Referring now to FIGS. 1, 2, and 3, the inflatable life raft 10 shown therein includes sidewalls 12, 14, 16, 18 in the form of inflatable tubular portions which become relatively rigid upon full inflation. The exact shape or construction of inflatable sidewalls vary somewhat among manufacturers of inflatable life rafts. For example, the sidewall may be in the form of a single-chamber tube or multi-chamber tube. Two or more separate tubes may be integrated to form the sidewall (as illustrated). This construction is usually preferred in that it provides a sidewall having a vertical dimension greater than its width or thickness. The tubes may be of substantially equivalent diameter, as shown in FIGS. 1–3, or may be of different diameters. Because the present invention applies equally, with only minor adjustments, to any of these sidewall types, one construction, i.e. double tubes of the same diameter, will be described in detail for the purpose of illustration.

A floor panel 20 extends between the sidewalls 12, 14, 16, 18. A second, bottom panel 22 may also be included so that occupants of the raft 10 will be somewhat insulated from the often cold water 25 beneath the raft 10. In such an embodiment, the floor 20 acts as a false bottom. Extending upwardly from the sidewalls 12, 14, 16, 18 of the raft body or hull are tubular air-filled members 22, 24, 26, 28. These tubular members will generally be referred to as canopy support tubes although the present invention does not require the use of an actual canopy. Each of these tubes extends from a predetermined position on an upper edge of a sidewall 12, 14, 16, 18 of the raft body at a predetermined outboard angle. At a predetermined position, the tube then turns to extend inboard to converge with the other tubes 22, 24, 26, 28 at a central location spaced above the floor 20 of the raft body. The structure of these support tubes 22, 24, 26, 28 will be described in further detail below including a detailed description of how each tube is dimensioned according to the present invention. Generally, each canopy support tube 22, 24, 26, 28 includes a lower portion 30 and an upper portion 32.

The raft 10 may also include a canopy-type cover 34 which is suspended above the raft body to protect the occupants from wind, rain and sun exposure. Generally, the canopy 34 is attached at its perimeter to the sidewalls 12, 14, 16, 18 and suspended centrally by loops 35 extending over support tubes 22, 26. The canopy 34 is typically made from a lightweight fabric which repels rain and wind but allows breatheability of the enclosed area of the raft 10. The remainder of the raft 10, including sidewalls 12, 14, 16, 18, floor 20, 22, and canopy support tubes 22, 24, 26, 28 are made of rubber or a rubberized fabric material which will contain an inflation gas, such as air or carbon dioxide, which is at a greater than atmospheric pressure. In this manner, these portions of the raft may be inflated to take on a relatively rigid form.

Referring now to FIGS. 7–12, in use, a raft 10 according to the present invention may be inflated in a commonly-known manner such as by using a compressed air or carbon dioxide canister 36. Typically, a life raft 10 of this type is deployed by first placing the raft 10 in a folded, deflated condition into the water 25, after which inflation gas is released from the canister 36 either automatically or by means of an actuation tether 38. In preferred form, the raft body (i.e. sidewall chambers 12, 14, 16, 18) are inflated first. This adds an increased degree of safety in that in the event the volume of gas contained in the canister 36 is inadequate to fully inflate all parts of the raft 10, the most critical portion (i.e. raft body) will have been inflated first. After full inflation of the raft body, check valves or pressure regulation valves will allow the gas to begin to inflate the canopy support tubes 22, 24, 26, 28.

Figure 8:
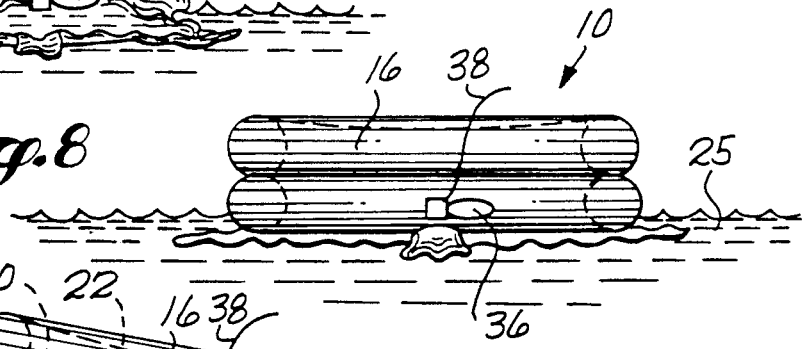

As illustrated in FIG. 8, it is often the case that the raft body inflates in an inverted position on the water 25. Prior to the present invention, a raft which inflated in an inverted position such as this, would have to be righted by a survivor in the water before it could be used. This can be especially difficult when the canopy which is hanging in the water 25 below the raft 10 is filled with water. Typical prior art canopy support tubes which were designed only for the purpose of elevating the canopy 34 do not have sufficient buoyancy (displacement) to even lift the raft body slightly from a completely inverted position.

Figure 9:
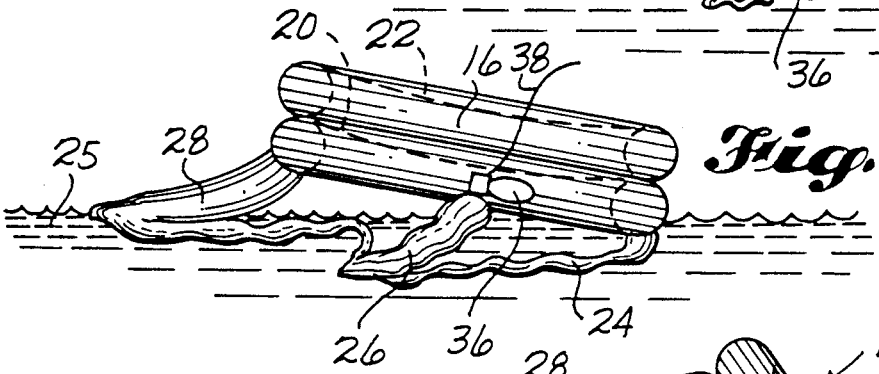
Figure 10:
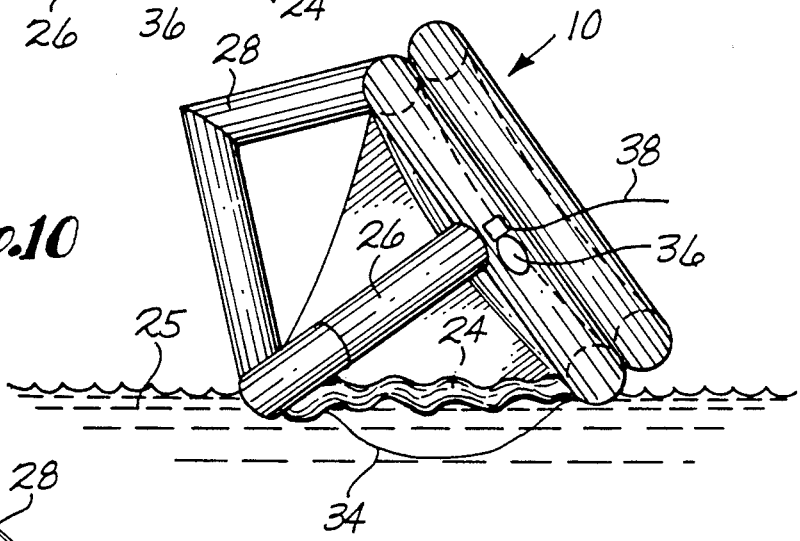

According to the present invention, as shown in FIG. 9, the canopy support tubes 22, 24, 26, 28 begin to inflate immediately after inflation of the sidewalls 12, 14, 16, 18 of the raft body. As shown in FIG. 10, as the canopy support tubes 22, 24, 26, 28 become more fully inflated, they become relatively more rigid and provide buoyancy sufficient to lift the raft body above the surface of the water 25 and into a substantially vertical position. During this portion of the canopy tube's inflation, water which was trapped within the canopy 34 drains out by gravity through entrance openings which are commonly found on both sides of the raft 10. In this manner, the raft 10 and canopy 34 are self-bailing.

Figure 11:
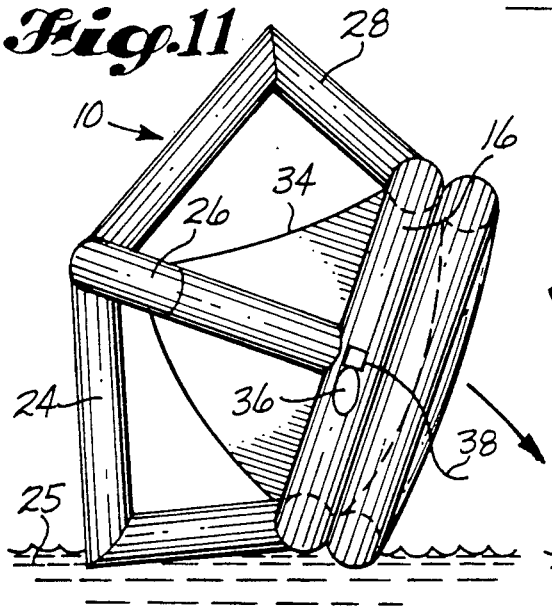
Figure 12:
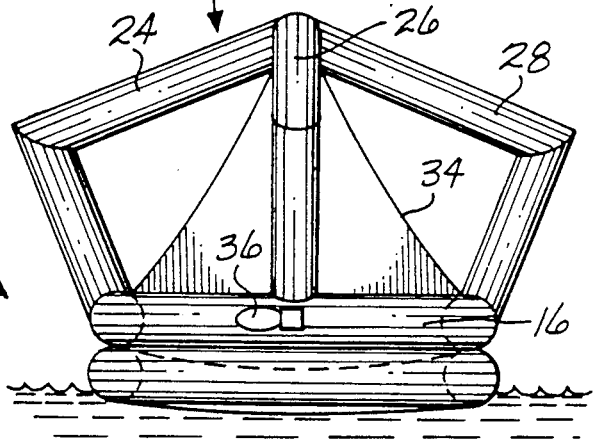

Referring now to FIG. 11, as the canopy support tubes 22, 24, 26, 28 become fully inflated, substantially all of the water within the raft body and canopy 34 is drained out and the hull of the raft is tilted beyond vertical to at least the minimum angle beyond which the raft body will topple by gravity to an upright position as shown in FIG. 12. As will be described in more detail below, this is accomplished by a predetermined positioning of buoyant members (i.e. canopy support tubes) outboard and above the sidewalls 12, 14, 16, 18 of the raft body a distance sufficient to force the raft body to be tilted beyond vertical this minimum angle at which it will topple by gravity into an upright position.

The shape of the canopy support tubes 22, 24, 26, 28 of the present invention will not allow the raft body to be supported in an inverted position lifted above the surface of the water 25 because the upper portions 32 of the canopy support tubes 22, 24, 26, 28 converge at an angle to a central point. When the raft 10 is in a completely inverted position and resting on the upper portions 32, it is unstable, causing it to be shifted toward one side. As the raft rolls and one or more of the upper portions 32 of the canopy support tubes 22, 24, 26, 28 becomes substantially parallel with the surface of the water 25, the raft 10 becomes even more unstable. In this position, the raft's center of gravity has now been shifted beyond the raft's effective point of rotation on the surface of the water 25. It should be noted that the effective point of rotation shifts as the raft rolls. This point or line of rotation represents the point or line of contact between the raft and the surface of the water. The raft is then moved toward a position in which one of the sidewalls 12, 14, 16, 18 and one of the lower portions 30 of the canopy support tubes 22, 24, 26, 28 are resting on the surface of the water 25 (see FIG. 11). As previously stated, at this point, the hull or body of the raft 10 is positioned at an angle such that its center of gravity is moved beyond the effective pivot point of the raft 10.

The distance of the raft's center of gravity from the pivot point acts as a moment arm such that the force of gravity acting on the raft's center of gravity creates a torque on the raft 10 in a direction toward an upright position which is greater than the torque acting on the raft 10 to move it toward an overturned position. In some positions, particularly during initial inflation, the torque acting on the raft to move it to its upright position is that of buoyancy (displacement of water mass) acting against gravity at a particular distance (moment arm) from the raft's point of rotation on the surface of the water 25.

Common nautical or shipbuilding terminology will be used herein and given its common meaning to the extent possible. The nature and shape of the hull of an inflatable life raft is somewhat atypical and, therefore, some common terminology will not directly apply. As used herein, the "beam" shall be used to denote the lateral measurement of the raft body from one outermost side, directly across the raft to the opposite outermost side. Because many raft designs are equal or nearly equal in length and width, no portion of the raft will be designated as a "bow" or "stern." In that respect, an oblong or irregularly-shaped raft body may have a longitudinal or major beam as well as a transverse or minor beam. In most instances described herein, a beam measurement is taken across the hull of the raft at locations where canopy support tubes 22, 24, 26, 28 intersect the upper edges of the sidewalls 12, 14, 16, 18. The "minimum outboard beam" refers to the beam measurement taken laterally or across the narrowest dimension of the raft from outboard edge to opposite outboard edge.

The "sheer line" shall be defined as a line extending across the hull of the raft 10 in any direction at the level of the sidewalls, 12, 14, 16, 18 upper edges. In this instance, the sheer line will be substantially parallel to the floor 20, 22 or what might otherwise be referred to as the deck line. The vertical height of the sidewall is measured from the sheer line or upper edge of the sidewall to the lower edge of the sidewall. Because rafts of this type float virtually completely on the surface of the water 25, especially when empty of occupants, the draught of the raft is negligible. In this manner, the vertical height of the sidewall is substantially equivalent to its "freeboard" (i.e. distance from upper edge of the sidewall to surface of the water) and will be used interchangeably.

According to the preferred embodiment, at least three canopy support tubes are required. For reasons that will become apparent from the explanation below, the greater the number of tubes which are used, the smaller each of them need be. Considerations relevant to choosing the exact number of canopy support tubes to be used are the amount and cost of material to be used and the adaptability of a particular number of tubes to the shape of the raft body. For optimum function, it is important that the tubes be evenly spaced about the circumference of the raft body.

Figure 13:
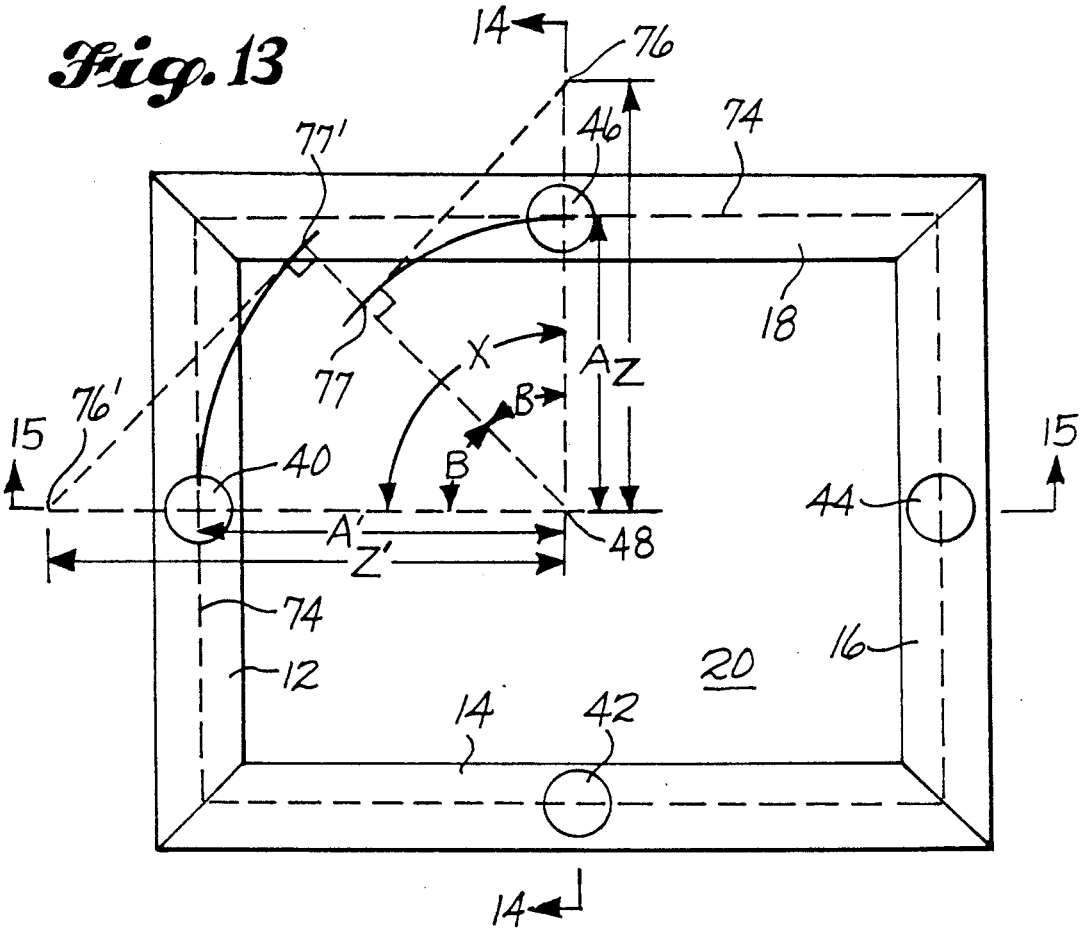
FIG. 13 is a schematic top view of an oblong raft showing various calculated dimensions.

In the illustrated example, four canopy support tubes 22, 24, 26, 28 are used. As shown in FIG. 13, each of these tubes is positioned to extend from the upper edge of a sidewall 12, 14, 16, 18 at regularly-spaced intervals 40, 42, 44, 46. Each of these locations 40, 42, 44, 46 is positioned an equal angle relative to one another from the sheer line midpoint 48. This angle X may be readily calculated from a plan view or should always represent the quotient of 360 degrees divided by the number of canopy support tubes used. In the illustrated embodiment, the angle X equals 90 degrees.

Figure 16:
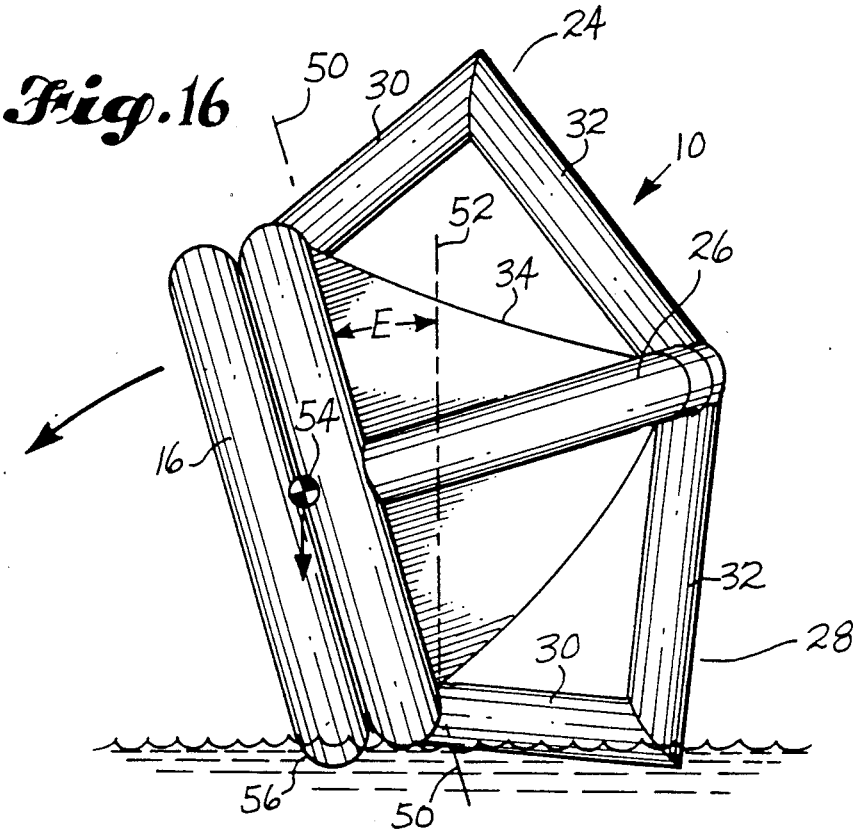
FIG. 16 is a side view of a raft according to the present invention situated in a position to show the minimum angle beyond vertical that the sheer line must be tilted to cause the raft body to topple by gravity to an upright position.

Another important calculation which must be determined is the critical deck angle or minimum angle beyond vertical which the sheer line 50 or deck line of the raft 10 must be moved from vertical 52 in order for the raft 10 to topple by gravity into an upright position. Referring to FIG. 16, this minimum angle E may be determined experimentally using a full size raft or scale model, or may be calculated by a determination of the raft's center of gravity 54 relative to the point 56 about which the raft 10 will pivot in the water. The distance between the center of gravity 54 and this arbitrary pivot point 56 will represent a moment arm on which the force of gravity (9.8 $m/s^2$ times the mass of the raft) will exert a determinable torque.

Numerous experiments have shown this angle to be from between 5 degrees and 15 degrees for most types of inflatable hull rafts. Generally, single-tube hulls require a lesser angle E than do multi-tube hulls, which, in turn, require slightly less than that for multi-tube hulls in which the tubes are of different diameters. In the illustrated embodiment, the angle E is 15 degrees.

Figure 14:
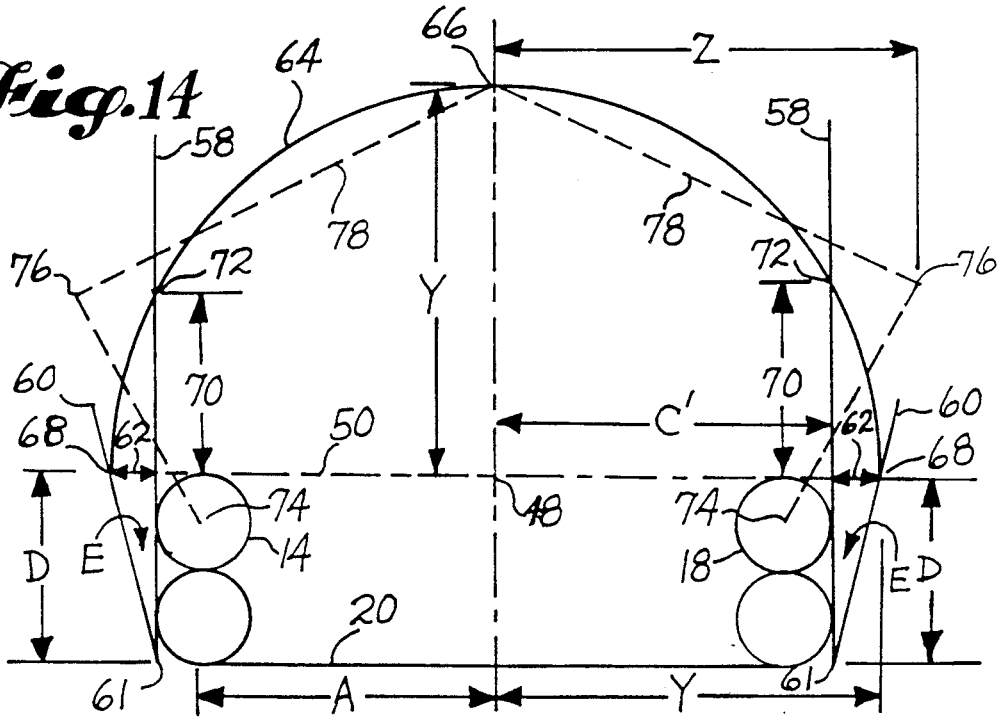
FIG. 14 is a schematic cross-sectional view taken substantially along line 14—14 of FIG. 13 showing various calculated dimensions.

Referring to FIG. 14, this angle E is used to determine the distance Y above the sheer line midpoint 48 that the canopy support tubes 22, 24, 26, 28 are to converge and the distance above the sheer line 50 or upper edge of the sidewall 12, 14, 16, 18 that the canopy tube is to reverse from its outboard-extending direction to an inboard-extending direction. Referring to FIG. 14, a vertical line 58 is positioned to extend upwardly at the outermost edge of the sidewall 12, 14, 6, 18. A second line 60 extends upwardly at an angle E outboard of the vertical line 58 and converges with the line 8 at a point 61 even with the bottom of the raft's sidewall 2, 14, 16, 18. A distance 62 is then measured between these lines 58, 60 at the sheer line 50. This distance 62 may be determined by actual measurement or may be calculated knowing the vertical height D of the sidewall 12, 14, 16, 18 and the angle E between the lines 58, 60. The distance 62 may be determined by multiplying the vertical height D of the sidewall times the tangent of the angle E in degrees. By this simple trigometric algorithm, the distance 62 may be determined.

The distance Y represents the sum of one-half the outboard beam of the raft (C, C') plus this calculated distance 62. In other words, the distance Y is the distance from the beam or sheer line midpoint 48 horizontally to the point at which the sheer line would intersect the line 60 which extends at angle E. This calculation is represented by the equation:

$$Y=(C'+(D\cdot\tan E')$$

To represent the commonality of this distance Y, an arc 64 is illustrated which intersects both the point of canopy support tube convergence 66 above the sheer line midpoint 48 and the intersection 68 of the sheer line 50 with the angled line 60. The point at which this arc 64 intersects the vertical line 58 at the outboard edge of the hull determines the vertical distance 70 above the sheer line 50 to which the lower portion 30 of the canopy support tube 22, 24, 26, 28 extends. In this manner, the point 72 is at an equal distance or radius from the sheer line midpoint 48 as are the point of convergence 66 and sheer line intersection 68.

To calculate the exact distance 70 of the sheer line 50 to which the lower portion 30 vertically extends, one may employ the following equation:

$$\sqrt{(C + D \cdot \tan E'))^2 - C^2}$$

This equation represents the Pythagorean theorem that in a right triangle, the sum of the sides squared equals the hypotenuse squared. In this case, the known factors are the hypotenuse, Y, and one of the sides, (C, C'), which is one-half of the outboard beam.

The outboard distance to which a given canopy support tube 22, 24, 26, 28 extends is determined as follows. First, referring to FIG. 13, the distance A represents the distance between the sheer line midpoint and a midline 74 of the hull sidewalls 12, 14, 16, 18 at the tube locations 40, 42, 44, 46. The lower portion 30 of the canopy support tube extends upwardly from the sidewall from approximately this midline 74.

Secondly, the angle X between adjacent tube positions 40, 46 is bisected to determine angle B. The outboard extension point 76, 76' is determined by locating the point 77, 77' at which a line extending at a right angle from the bisection of angle X at a distance A, A' from the sheer line midpoint 48 will intersect a radius of the sheer line midpoint extending through the axial center 74 of the canopy support tube location 46. This may be viewed graphically in FIG. 13 and may be calculated by the following equation:

$$\frac{A}{\cos B^\circ}$$

Again, using a simple trigometric algorithm, the hypotenuse Z of a right triangle may be determined by dividing the length of a known side adjacent to a known angle by the cosine of that known angle (in degrees).

Figure 15:
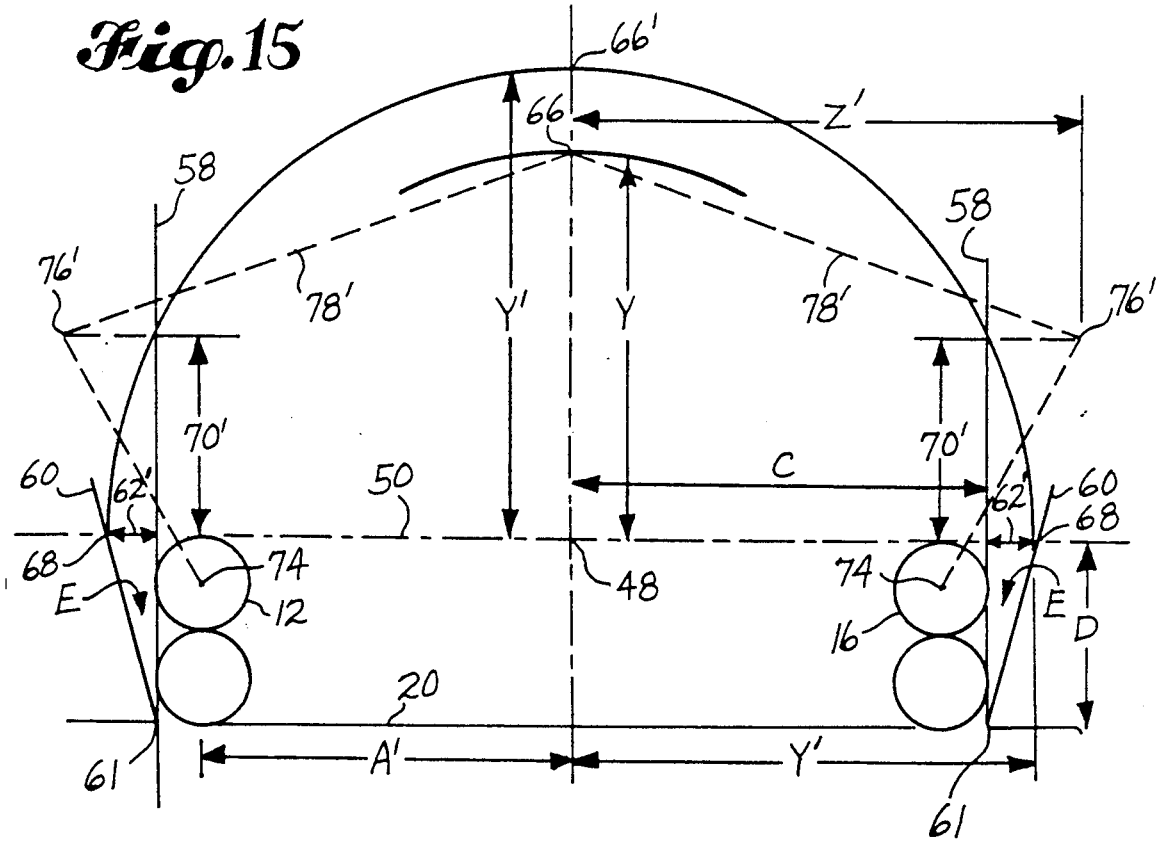
FIG. 15 is a schematic cross-sectional view taken substantially along line 15—15 of FIG. 13 showing various calculated dimensions.

The above calculations represent the dimensions and specifications of the canopy support tubes 22, 24, 26, 28 measured at their axial centerline 78, 78'. Referring to FIGS. 3 and 14, the axial centerlines of canopy support tubes 24, 28 extend from a centerline 74 of the sidewalls 14, 18 upwardly and outboard to a predetermined point 76 and then upwardly and inboard to a point of convergence 66 which is spaced upwardly a distance Y above the sheer line midpoint 48. Referring to FIG. 15, the positioning of an axial centerline 78' for the other canopy support tubes 22, 26 may be calculated in a similar manner. It will be noted that because the longitudinal outboard beam of the raft 10 is longer than the transverse outboard beam, the points 76 will be spaced a vertical distance 70' which is greater than that for the side canopy support tubes 24, 28 and, likewise, will be spaced outboard a distance Z' which is greater than that of the lateral canopy support tubes 24, 28.

It should also be noted that the distance Y' above the sheer line midpoint 48 at which the centerlines 78' would normally converge, 66, does not intersect with the point of convergence 66 of the lateral canopy support tubes 24, 28. This situation may be remedied in a number of ways. For the sake of convenience and conservation of materials, it is preferred that each of the canopy support tubes 22, 24, 26, 28 be selectively positioned for actual convergence. This may be accomplished either by adjusting upwardly or downwardly either set of canopy support tubes 22, 26; 24, 28. It has been found through experimentation that the canopy support tubes 22, 24, 26, 28 may be adjusted to the lowest calculated point of convergence 66 with satisfactory results. Because all of the above-described calculations represent minimum distances to which the means for self-righting the raft must be dimensioned, the actual specifications for manufacture may, of course, be extended beyond these minimum requirements.

As can readily be seen, this invention and the calculations which represent its preferred embodiment may be easily adapted to virtually any size or shape of life raft. In essence, the invention provides a buoyant member spaced outwardly and above the raft body a predetermined distance from the point or line of rotation upon which the raft body rotates on the surface of the water. The buoyancy of this member in the water provides an upward lift which is opposite the force of gravity. This upward force is multiplied by its moment arm or distance from the raft's rotation point. This force on the moment arm creates a torque on the raft sufficient to move the raft's center of gravity beyond vertical alignment with the point of rotation. At this point, the force of gravity acting on the center of gravity at a distance or moment arm from the point of rotation pulls the raft into an upright position. This same principle applies whether the raft is being righted upon initial inflation or is being righted after being overturned by high winds or rough seas.

Referring to FIG. 4 in which is shown a top plan view of a square life raft according to the present invention, it can be seen that because the beam of the raft body 80 is the same in both directions, each canopy support tube 82 can be made the same general size and shape. Likewise, referring to FIG. 6, when applied to a circular raft 84 or a multi-sided raft in which the beam measured in all directions is substantially the same, the canopy support tubes 86 will also be of equal dimensions.

Referring to FIG. 5, when four canopy support tubes 88, 88' are evenly spaced around the circumference of a hexagonal raft body 90, the dimensioning of the canopy support tubes 88, 88' will be similar to those described with respect to an oblong raft body. In this manner, a cross-section taken substantially along line 14—14 of FIG. 5 would be comparable to that shown in FIG. 14 and a cross-section taken substantially along line 15—15 would be substantially represented by that shown in FIG. 15. Likewise, the canopy support tubes 88' which are positioned at the longitudinal beam of the raft body 90 would be greater in outboard extension than the transverse canopy support tubes 88.

Of course, a hexagonal raft body 90 as shown in FIG. 5 could be outfitted with three evenly-spaced canopy support tubes 92, each of which would be substantially identical in size and shape. However, because the angle X between adjacent tubes 92 would be increased to 120 degrees, the outboard extension factor Z of each tube would likewise be increased. An analysis of which embodiment would present the most cost-effective utilization of materials and labor would influence the decision of which of these alternative embodiments to employ. Of course, increasing the number of canopy support tubes to a number greater than four would result in a decrease in the dimensioning of each of the tubes. However, the per tube conservation of materials would likely be offset by the amount of material used for the additional tubes. Each of these considerations, including size and weight requirements, should be carefully considered in determining how best to implement this invention for a particular application.

As previously stated, the above-described calculations are used in determining the position of axial centerlines of the canopy support tubes. Complete construction specifications (i.e. diameter of the tubes) may easily be determined by calculation of the buoyancy (displacement) necessary to offset and lift the total mass of the raft. The total mass of the raft, of course, will vary depending upon its size and shape, but is easily ascertained. Keeping in mind that seawater weighs 64 pounds per cubic foot, the volume which must be displaced to lift the mass of the raft may easily be calculated. It must be realized that, as shown in FIGS. 11 and 16, the displacement or buoyancy of a single canopy support tube operates to exert the final rotational movement on the raft. In this manner, it is the above-described moment arm of the upward force on the canopy support tube which is acting to rotate the center of gravity of the raft beyond its point of rotation on the surface of the water. If desired, the diameter of the canopy support tubes may taper, having a smaller diameter at their upper point of convergence 66 and a larger diameter at the outboard elbow 76 and in the lower portion 30.

It should be understood that many variations may be made in the form and appearance of the present invention. The requirements described are minimum requirements and, therefore, may be expanded freely as desired. The above-described embodiments are exemplary only and, therefore, are not to be interpreted as a limitation of the scope of my invention or patent protection. The scope of my patent protection is to be limited only by the following claim or claims interpreted according to recognized doctrines of claim interpretation, including the doctrine of equivalents.

What is claimed is:

1. A self-righting inflatable life raft, comprising:

a raft body including inflatable sidewalls and having determinable beams measured between opposite outboard edges of said sidewalls, said sidewalls having an upper edge and a sheer line being defined substantially between sidewalls at said upper edge, said sheer line having a midpoint substantially centered between the sidewalls;

a means for righting said raft body including a plurality of inflatable tube portions each having a central longitudinal axis which extends from said upper edge to a first predetermined position upwardly and outboard from the upper edge and which then extends inboard to centrally converge with another of said inflatable tube portions at a second predetermined position above said sheer line, said first position being spaced outboard at least a horizontal distance substantially determined by the equation:

$$\frac{A}{\cos B^{\circ}}$$

said first position being spaced upwardly above the sheer line at least a vertical distance substantially determined by the equation:

$$\sqrt{(C + D \cdot \tan E^{\circ}))^2 - C^2}$$

said second position being spaced vertically above the sheer line midpoint at least a distance substantially determined by the equation:

$$C' + (D \cdot \tan E')$$

where:

A = the distance from the sheer line midpoint to the axial center of the tube portion at the upper edge of the sidewall; and B = one-half the angle in degrees between the axial center of adjacent tube portions at said upper edge, said angle having its vertex at the sheer line midpoint;

C = one-half of a major beam of the raft body;

C' = one-half of a minor beam of the raft body;

D = the vertical height of the sidewall; and

E = the minimum angle in degrees beyond vertical that the sheer line must be tilted to cause the raft body to topple by gravity to an upright position;

said righting means being sized to provide buoyancy at least equal to the mass of the raft.

2. The life raft of claim 1, wherein said inflatable tube portions are evenly spaced at predetermined intervals around said upper edge of said inflatable sidewalls.

3. The life raft of claim 1, further comprising a canopy supported by said righting means, said canopy and said sidewalls defining a substantially enclosed compartment.

* * * * *

UNITED STATES PATENT AND TRADEMARK OFFICE

CERTIFICATE OF CORRECTION

PATENT NO. : 4,998,900

DATED : March 12, 1991

INVENTOR(S) : Derek Wright

It is certified that error appears in the above-identified patent and that said Letters Patent is hereby corrected as shown below:

Col. 1, line 55, "suggest" should be -- suggests --.
Col. 5, line 56, "sidewalls," should be -- sidewall's --
Col. 6, line 52, "12, 14, 6, 18" should be -- 12, 14, 16, 18 --;
line 54, "line 8" should be -- line 58 --; and
line 55, "sidewall 2" should be -- sidewall 12 --.
In col. 7, line 5, the correct formula should be:

$$Y = (C' + (D \cdot \tan E))$$

In col. 7, line 24, the correct formula should be:

$$\sqrt{(C + (D \cdot \tan E^\circ))^2 - C^2}$$

Col. 8, line 8, "converge, 66" should be -- converge, 66' --.
Claim 1, col. 10, lines 25 and 26, the correct formula should be:

$$\sqrt{(C + (D \cdot \tan E^\circ))^2 - C^2}$$

UNITED STATES PATENT AND TRADEMARK OFFICE

CERTIFICATE OF CORRECTION

PATENT NO. : 4,998,900

DATED : March 12, 1991

INVENTOR(S) : Derek Wright

It is certified that error appears in the above-identified patent and that said Letters Patent is hereby corrected as shown below:

Claim 1, col. 10, lines 32 and 33, the correct formula should be:

$C' + (D \cdot \tan E°)$

Signed and Sealed this

Twenty-eighth Day of July, 1992

*Attest:*

DOUGLAS B. COMER

*Attesting Officer*

*Acting Commissioner of Patents and Trademarks*